US010745227B1

(12) United States Patent
Hill

(10) Patent No.: US 10,745,227 B1
(45) Date of Patent: Aug. 18, 2020

(54) PACKAGING APPARATUS

(71) Applicant: QUALITY PACKAGING CORP., High Point, NC (US)

(72) Inventor: Jerry L. Hill, Oak Ridge, NC (US)

(73) Assignee: Quality Packaging Corp., High Point, NC (US)

( * ) Notice: Subject to any disclaimer, the term of this patent is extended or adjusted under 35 U.S.C. 154(b) by 720 days.

(21) Appl. No.: 15/336,940

(22) Filed: Oct. 28, 2016

(51) Int. Cl.
*B65H 16/00* (2006.01)
*B65H 35/08* (2006.01)
*B65H 35/06* (2006.01)

(52) U.S. Cl.
CPC ..... *B65H 16/005* (2013.01); *B65H 35/06* (2013.01); *B65H 35/08* (2013.01); *B65H 2701/1762* (2013.01); *B65H 2701/1944* (2013.01)

(58) Field of Classification Search
CPC ..... B65B 41/02; B65B 41/10; B65B 11/00; B65H 16/005
USPC ..... 53/389.1–389.3, 168, 203; 242/599.1–599.4, 598.2, 590, 597.5, 242/597.1
See application file for complete search history.

(56) References Cited

U.S. PATENT DOCUMENTS 2,116,410 A * 5/1938 Parks ..... B65H 54/44 242/486.6
2,396,805 A * 3/1946 Schwartz ..... B65H 35/0006 242/423.1
3,247,645 A 4/1966 Van Antwerpen et al.
3,416,649 A * 12/1968 Snow, Jr. ..... B29C 65/18 206/497
4,296,589 A * 10/1981 Kruse ..... B65B 7/164 156/522
5,203,761 A * 4/1993 Reichental ..... B26D 1/185 493/346
5,546,729 A * 8/1996 Pienta ..... B65B 11/04 53/136.2
2005/0029391 A1* 2/2005 Cocciadiferro ..... B65H 19/10 242/559.1
2006/0218881 A1* 10/2006 Sperry ..... B65B 9/02 53/411
2009/0308964 A1* 12/2009 Chudy ..... B65B 61/28 242/412.1
2013/0047554 A1* 2/2013 Bertram ..... B65H 23/182 53/452

(Continued)

*Primary Examiner* — Andrew M Tecco
*Assistant Examiner* — Nicholas E Igbokwe
(74) *Attorney, Agent, or Firm* — Tuggle Duggins P.A.; Blake P. Hurt

(57) ABSTRACT

A packaging apparatus including a base to pivotable attachment to one or more spindles and rigid attachment to a cutting cabinet and a control device to more efficiently automate the process of wrapping an article with a web material is disclosed. The cutting cabinet includes a pneumatically powered, rotating blade carried by a cylinder positioned on an air cylinder within the cutting cabinet, permitting the blade to displace vertically almost the entire longitudinal length of the cabinet. A pair of powered rollers are also positioned within the cutting cabinet so that the web material may be fed from the larger supply stored on the spindle into the cutting cabinet in a predetermined manner as dictated by the control device so that a predetermined length of web material may be distributed and used to package an article, regardless of whether subsequent articles are the same size or not.

19 Claims, 8 Drawing Sheets

(56) References Cited

U.S. PATENT DOCUMENTS

2016/0355283 A1* 12/2016 Capitani ..... B65B 31/028

* cited by examiner

PACKAGING APPARATUS

FIELD OF THE INVENTION

The invention herein pertains to packaging equipment and particularly pertains to a wrapping machine for housing and dispersing a web material, typically but not exclusively rolls of paper, and especially of single-face corrugated substrate.

DESCRIPTION OF THE PRIOR ART AND OBJECTIVES OF THE INVENTION

Wrapping machines that deploy a web material around an article for the purpose of packaging the article for shipping or transportation are known in the art. These types of machines are often grouped into at least two separate types. The first type is a continuous wrapping machine which, as its name suggests, releases a continuous supply of web material that is either mechanically or manually affixed around the article, often with a separation device in the form of a blade or knife used to remove the estimated necessary length of web material from the total supply. The second type of machine is engaged, either electronically or manually, to repetitively produce a uniform length of web material that is then either mechanically or manually affixed around the article, again with the assistance of a separation device as described above. These prior art machines suffer from a number of shortcomings which should be clear even to the lay observer, but perhaps the most important inadequacy is shared. These devices have no scalable solution to the variables inherent in the manufacturing process. Despite speed controls, both machines produce web material as expected until shut off, either continuously or in a repetitive manner, and adjustments to the amount of web material dispersed are costly and labor-intensive. This problem is particularly acute in manufacturing settings where the size and shape of the article to be wrapped may vary from one dispersal event to the next. For example, the custom cabinet industry is growing rapidly at the present time, as homeowners seek to refurbish dated residential spaces with updated fixtures. Given the high cost of shipping cabinets completely enclosed in sturdy cardboard boxes, it is more desirable to enclose and reinforce the cabinet ends, and wrap the intervening space with a less robust, and therefore lighter, material. However, even within a single order, the size and shape of the cabinets being wrapped may vary greatly, upsetting the business efficiency of the drop-ship business model.

Thus, in view of the problems and disadvantages associated with prior art devices, the present invention was conceived and one of its objectives is to provide a packaging apparatus that carries and deploys one or more types of web material.

It is another objective of the present invention to provide a packaging apparatus that includes a base section, a separation station, and an electronic control device.

It is still another objective of the present invention to provide a packaging apparatus that has two or more spindles for distributing a web material defined by single-face corrugated sheet.

It is yet another objective of the present invention to provide a packaging apparatus with a pneumatically powered, rotating blade electronically controlled by the control device.

It is a further objective of the present invention to provide a control device with computation logic configured to calculate the appropriate desired length of web material to distribute to adequately wrap an article.

It is still a further objective of the present invention to provide a packaging apparatus that is efficient to manufacture and install as well as easy to use.

It is yet a further objective of the present invention to provide a method of packaging an article including the steps of providing a packaging apparatus with a base, a pair of web material-dispensing spindles, and an electronic control device, programming the control device with software to distribute a predetermined length of web material selected from a group of predetermined web material lengths, and cutting the web material for manual or mechanical packaging of an article.

It is another objective of the present invention to provide a packaging apparatus with a plurality of spindles for distributing selectively predetermined single-face corrugated sheets of different widths coupled with computation logic to dissect the web material in a multiplicity of lengths to bestow upon the apparatus a greater range of operational flexibility.

Various other objectives and advantages of the present invention will become apparent to those skilled in the art as a more detailed description is set forth below.

SUMMARY OF THE INVENTION

The aforesaid and other objectives are realized by providing a packaging apparatus including a generally square base formed by tubular members that serves as a platform for one or more spindles that are rotatably mounted to the base with a fixed pin and clevis attachment and a displacing pin and clevis attachment. The one or more spindles are laterally offset relative to the middle of the square base, making room for a separation station in the form of a cutting cabinet formed by vertical tubular supports and housing a rotating blade. The circular knife blade is held within a pneumatically powered cylinder that travels vertically within the cutting cabinet. One or more feed rolls are mechanically attached to a motor housed proximate the apparatus and vertically oriented within the cutting cabinet to pass a web material stored on the one or more spindles through large and small material guides and position the material to be cut by the rotating blade. A control device is in electronic communication with both the rotating blade and the feed rolls, and includes electronic instructions operatively present within the control device to receive user input designating the article to be packaged, distribute the appropriate length of web material from the spindle, and cut the predetermined length of web material with the knife blade, thus freeing the appropriate amount of web material to package the article as desired. A method of packaging an article including the steps of providing a packaging apparatus as described above, programming the control device with software to distribute a predetermined length of web material selected from a group of predetermined web material lengths, and cutting the web material for manual or mechanical packaging of an article is also provided.

DETAILED DESCRIPTION OF THE PREFERRED EMBODIMENT AND OPERATION OF THE INVENTION

Figure 1:
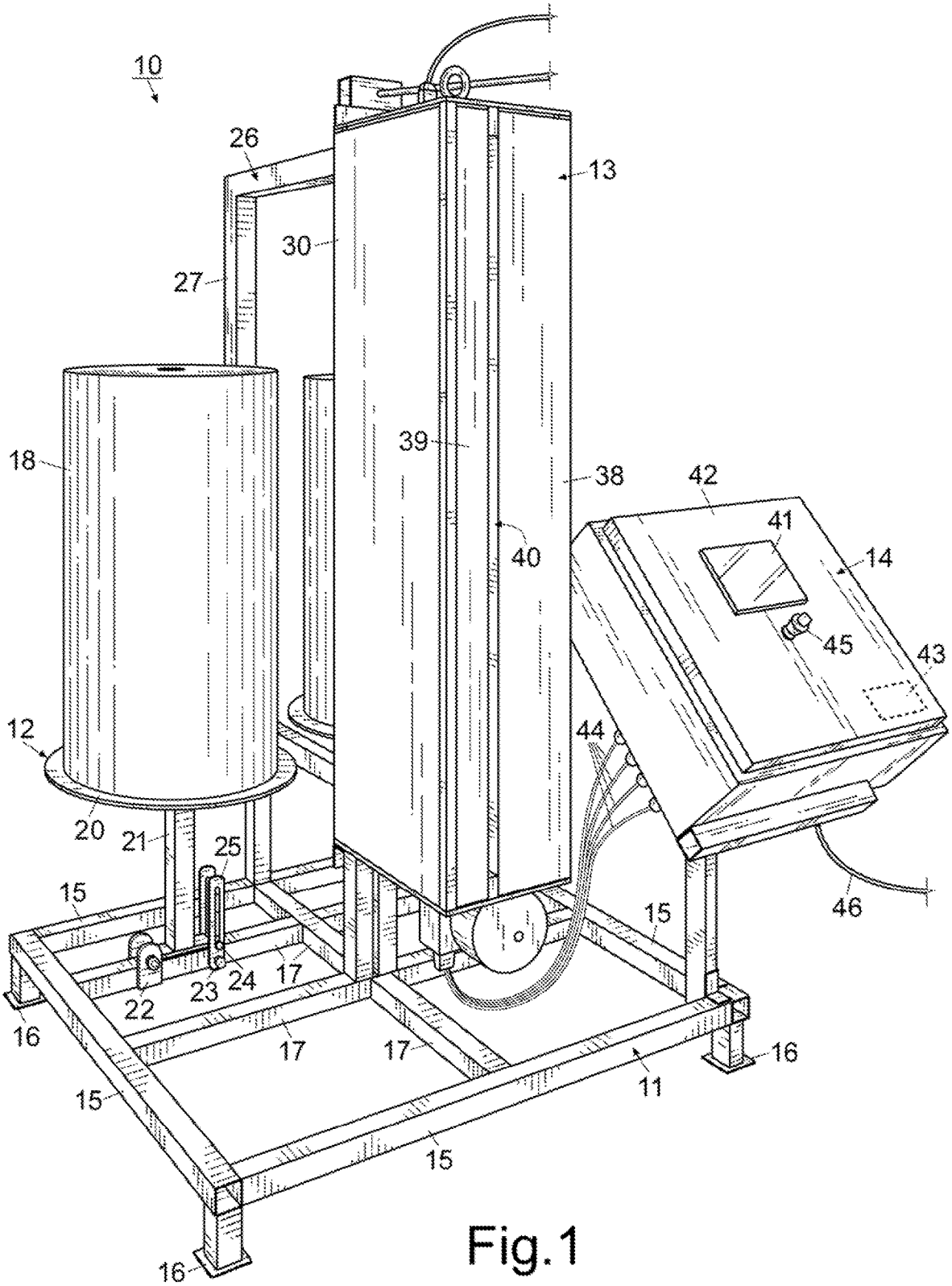
FIG. 1 shows an elevated side perspective view of a packaging apparatus.

For a better understanding of the invention and its operation, turning now to the drawings, FIGS. 1-5 display a preferred embodiment of packaging apparatus 10, which includes base 11, one or more spindles 12, and cutting cabinet 13 in electronic communication with control device 14. As shown more clearly in FIG. 1, the preferred embodiment of base 11 defines a generally square shape and is formed by a plurality of metallic tubular base members 15. Each corner of base 11 preferably includes foot 16 which may be formed from the same tubular construction as tubular base members 15 and extends downwardly therefrom to create a structural stable platform on which to mount spindles 12, cutting cabinet 13, and control device 14. Although not shown in the figures, an embodiment of foot 16 may include an adjustable feature to assist in the leveling of packaging apparatus 10, particularly useful in unfinished or unleveled manufacturing spaces. Further, base 11 also supports frame 26 that is formed from one or more tubular frame members 27 in a generally rectangular shape that extends vertically in a perpendicular orientation relative to base 11.

A preferred embodiment of base 11 includes metallic cross-members 17, defining the same tubular cross-section as base members 15, one that extends generally perpendicularly from approximately a mid-point of a first base member 15 and connects to approximately a mid-point of a second base member 15, preferably the opposing base member 15 that is oriented in parallel relationship to the first base member 15. Preferred base 11 includes at least four (4) cross-members 17 that join within the periphery of base 11, bestowing added structural stability to base 11, but it should be understood that the number, length and orientation of cross-members 17 are not intended to be limiting, and more or less cross-members 17 may be deployed within base 11, and the orientation of said cross-members 17 may vary as well. While base members 15 and cross-members 17 may be affixed by adhesives, mechanical fasteners, or the like, the preferred method of attachment of respective base members 15 and cross-members 17 is welding.

Figure 2:
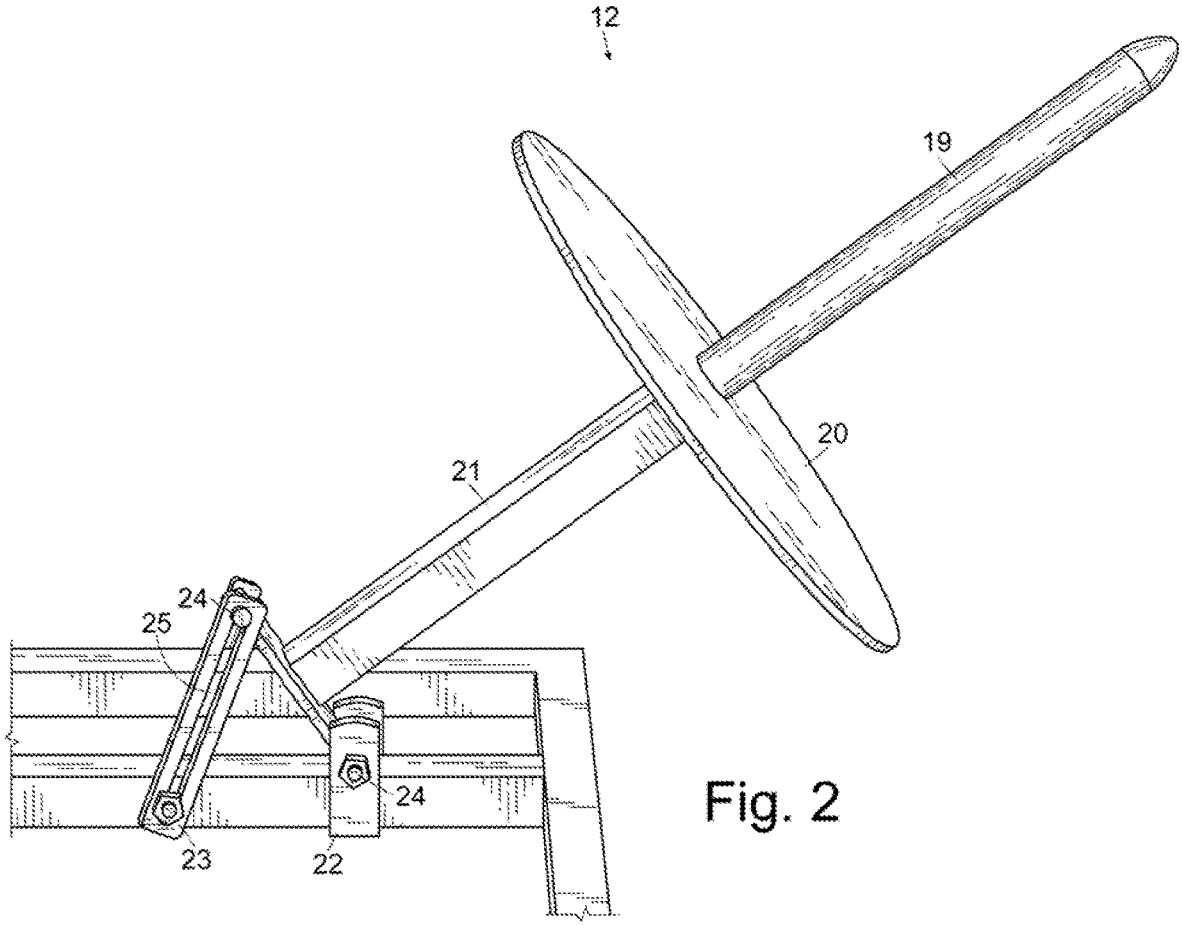
FIG. 2 pictures a spindle of the packaging apparatus of FIG. 1 in a second position.

In addition to the structural support features, base 11 also serves as the mounting substrate for cutting cabinet 13, control device 14, and the attachment of one or more spindles 12. As demonstrated in FIGS. 1 and 2, preferred packaging apparatus 10 includes one or more, and preferably two (2) pivotable spindles 12 that rotate from a first, more vertical position (FIG. 1) to a second, more angular position (FIG. 2) to aid in the unloading and loading of web material 18. Each spindle 12 preferably includes axle 19 attached to shield 20 which in turn is carried by tubular post 21 formed in the same manner as base members 15 and cross-members 17. Tubular post 21 is pivotably attached to base 11, and more particularly to at least one cross-member 17, by virtue of one or more clevises. Each spindle 12 preferably includes one fixed clevis 22 and one displacing clevis 23, each configured (i.e. sized and shaped) to receive a portion of tubular post 21, in addition to pins 24, between the respective ears. Clevis 22 is considered "fixed" to the extent that pin 24 rotates, but does not vertically or laterally displace, while clevis 23 is considered "displacing" in that pin 24 laterally or longitudinally, but preferably both laterally and longitudinally relative to base 11, displaces within longitudinal slot 25 when spindle 12 moves from the first position to the second position as illustrated in FIGS. 1 and 2.

Figure 3:
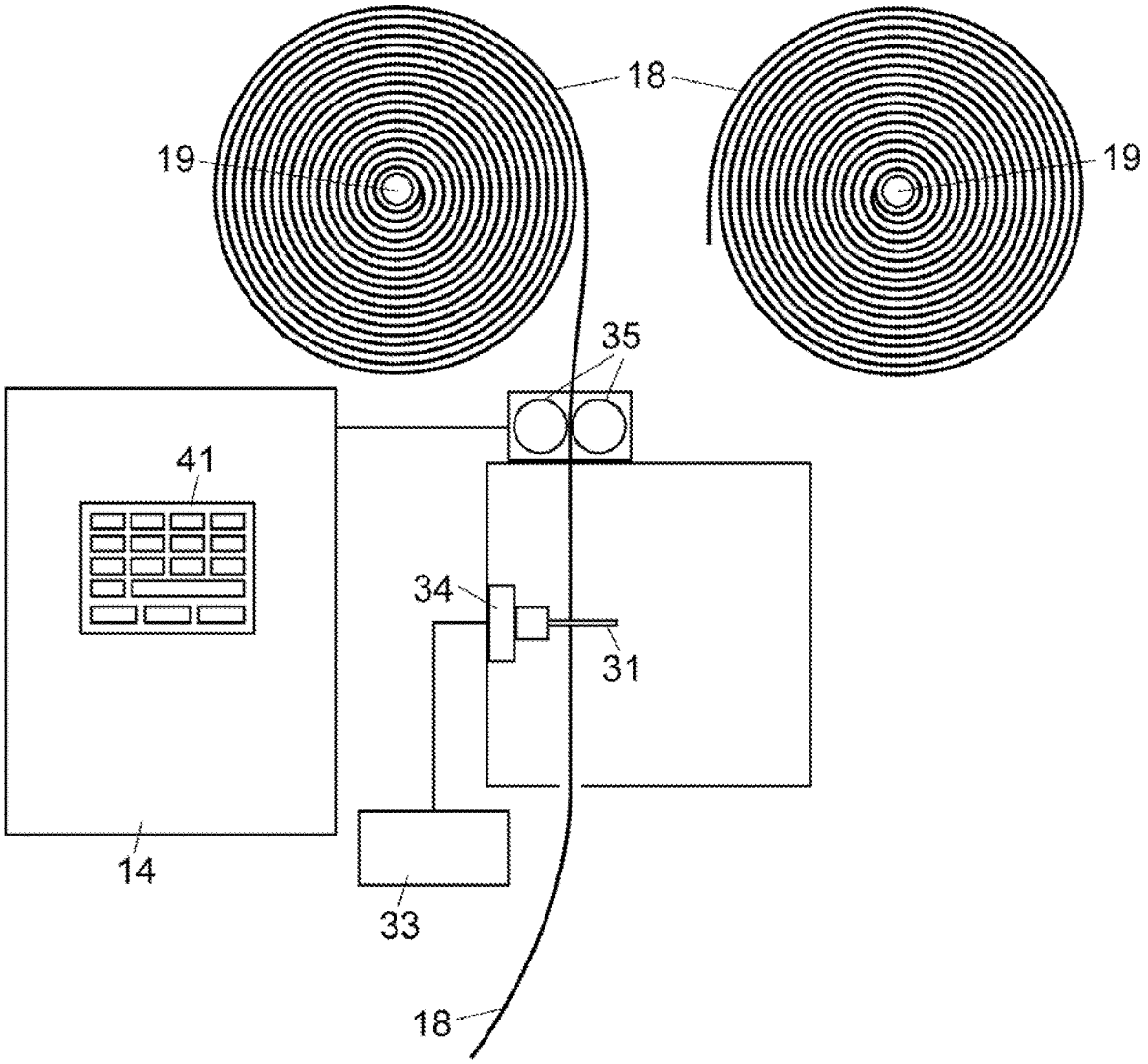
FIG. 3 depicts a schematic diagram of the packaging apparatus of FIG. 1.
Figure 4:
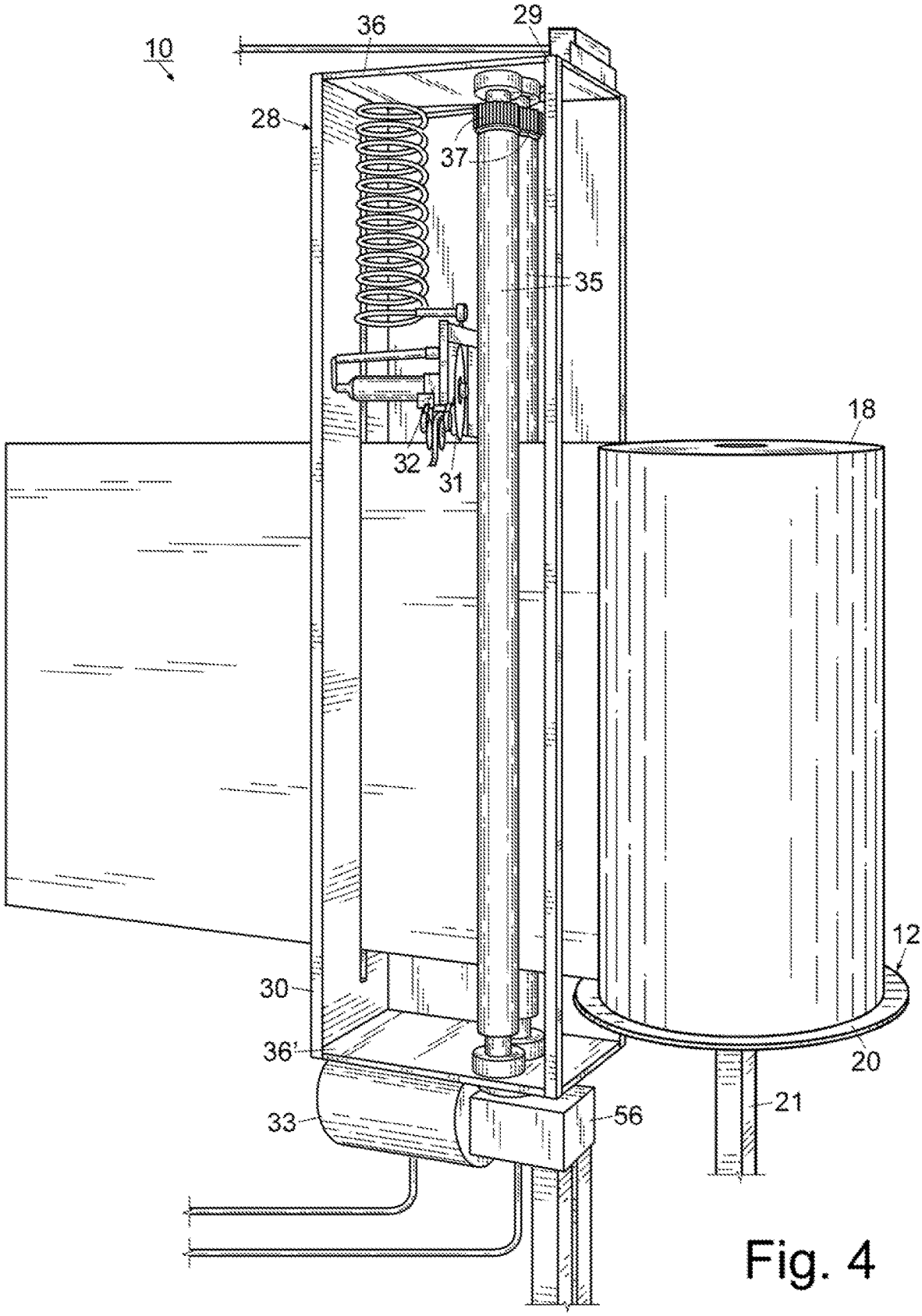
FIG. 4 demonstrates an elevated side view of the packaging apparatus of FIG. 1 with the blade prior to cutting the web material.
Figure 5:
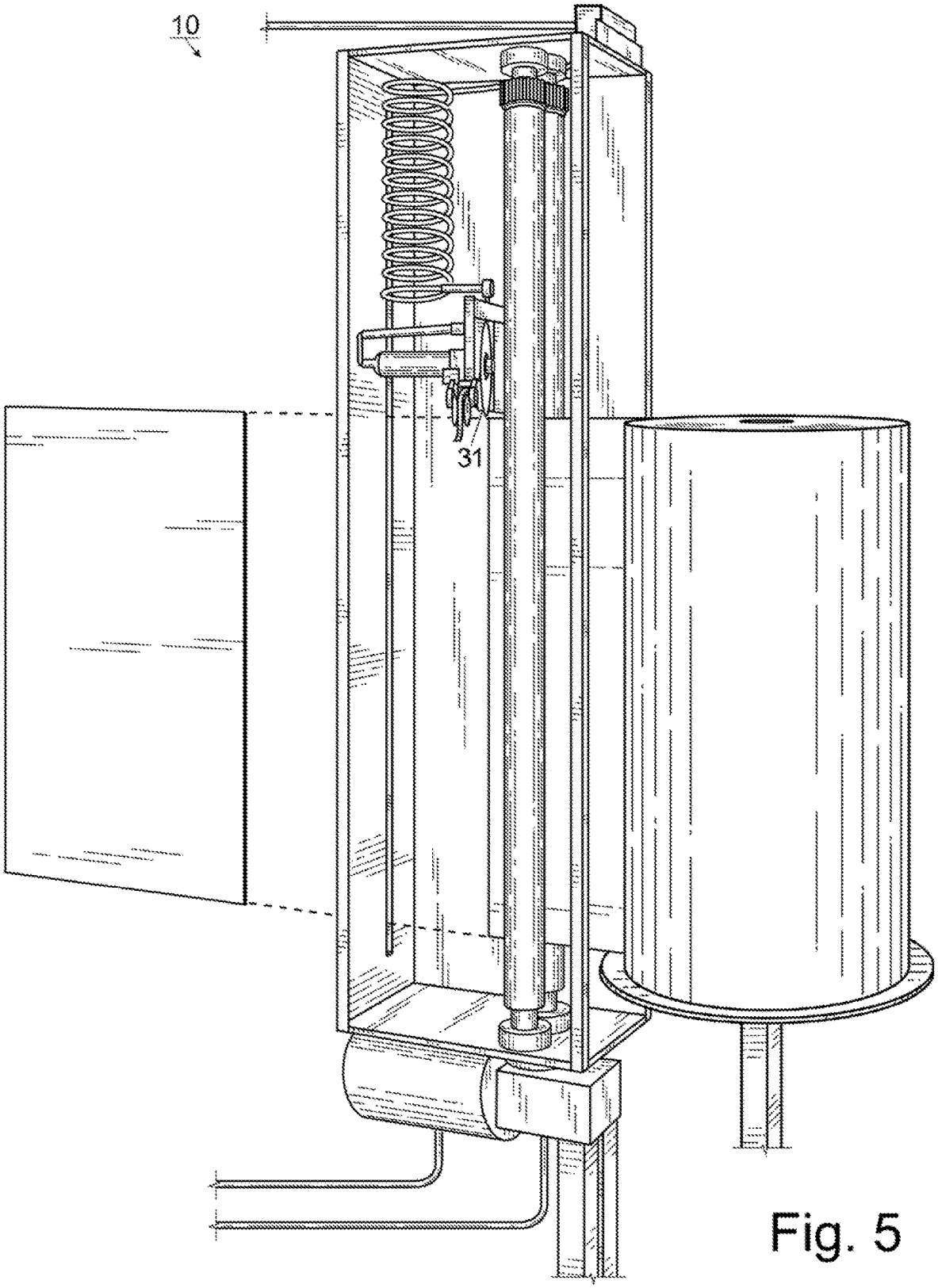
FIG. 5 illustrates an elevated side view of the packaging apparatus of FIG. 1 with the blade after cutting the web material.

As demonstrated schematically in FIG. 3 and illustrated in FIGS. 4 and 5 with cover plate 30 removed, cutting cabinet 13 is a web material separation station whereby web material 18 is unspooled or otherwise removed from spindles 12 as will be described in further detail below and separated from the larger web material supply based on one or more predetermined variables, usually length, for use in the packaging of a given article such as a cabinet (not shown). As demonstrated more clearly in FIGS. 4-5, cutting cabinet 13 is defined by a generally rectangular housing 28 defined by a plurality of stanchions 29 and preferably including one or more cover plates 30 joined at opposing ends by respective plates 36, 36' to protect the interior components of cutting cabinet 13. The primary function of cutting cabinet 13 as described above is served by one or more blades 31 carried by air motor 32 that travels the substantial vertically longitudinal length of cutting cabinet 13 during a cutting event. Preferably, blade 31 is a rotating, circular knife blade disposed within a pneumatically powered air motor 32 in communication with motor 33 via air cylinder 34 (FIG. 3) and associated attachment hardware (i.e. hoses, couplings, fasteners, and the like) as would be understood in the art. Other cutting members such as electric blades, hydraulic blades, and the like should also be construed as within the scope of packaging apparatus 10. When fully assembled, air cylinder 34 extends vertically nearly the entire height of cutting cabinet 13, granting travel to cylinder 32 and blade 31 a tremendous distance relative to the prior art and permitting packaging apparatus 10 to accommodate web material 18 of significant length and width as dictated by the size and shape of the article to be packaged.

Web material 18 is fed from spindles 12 through cutting cabinet 13 by virtue of one or more cylindrical rollers 35. For the purposes of this disclosure, the term "web material" is intended to encompass, though not be limited to, paper, foam, plastic, and film, but preferably refers to single-face corrugated substrate, which is viewed as structurally inferior to a conventional cardboard box and thus is highly disfavored in the packaging industry. Further, web material may also include secondary substrates combined with the aforementioned materials, such as a plastic lining adhered to the corrugated side of the single-face corrugated described above. Preferably, at least one pair of rollers 35 are oriented vertically and positioned abutting the rear of, and parallel to the longitudinal length of cutting cabinet 13. This positioning and orientation places rollers 35 in close proximity to the supply of web material 18, reducing the likelihood of damage to web material 18 during operation of packaging apparatus 10. One of cylindrical rollers 35 includes a driveshaft (not shown) in mechanical engagement with motor 33 via gear box 56 at a first end, and both rollers 35 include gear 37 for enmeshed engagement at the opposing end. In this manner, a single motor 33 can engage multiple rollers 35 without the need for additional mechanical engagements.

Although not shown in the figures, preferred packaging apparatus 10 also includes a biasing member, for example a spring, that biases respective rollers 35 together, such that once web material 18 is fed through said rollers, a certain degree of tension is placed on the web such that it does not fall out of engagement with rollers 35 and damage said web.

Preferred packaging apparatus 10 may also include one or more large paper guides 38 alone or in combination with one or more small paper guides 39, as best shown in FIG. 1. Both large paper guides 38 and small paper guides 39 are formed from elongated portions of metal and define an angular shape somewhat similar to the shape of an L. When installed along the longitudinal length of cutting cabinet 13, large paper guides 38 and small paper guides 39 ensure that web material 18 passes without complication from spindle 12 into cutting cabinet 13. More preferably, small paper guide 39 is installed more proximal to rollers 35 while large paper guide 38 is installed more distal to rollers 35, defining channel 40 to pass web material 18 therethrough after being cut within cutting cabinet 13 by blade 31, in addition to providing clearance space for blade 31 and cylinder 32.

The operation of packaging apparatus 10 is controlled primarily through the electronic operation of control device 14. In a preferred embodiment of packaging apparatus 10, control device 14 is in the nature of a control panel with touch screen 41 for manual engagement by a user, housing 42 containing circuitry and electronic storage (identified schematically in dotted fashion) 43, power cord 46 to provide power to control device 14, connection wires 44 to establish electronic communication with motor 33, gear box 56, and power button 45 to engage and disengage the operation of packaging apparatus 10. Additionally, electronic instructions in the form of computer software, computer code, or the like, are stored in or on circuitry and electronic storage 43 to govern the operation of packaging apparatus 10, particularly the engagement of motor 33 and gear box 56 with roller 35 and the activation of blade cylinder 32 carrying blade 31 within cutting cabinet 13. These instructions embody the logic of receiving specific dimensions for articles to be wrapped (i.e. programming), calculating the necessary run time of rollers 35 necessary to feed one or more predetermined lengths of web material 18 from spindle 12 into cutting cabinet 13, adjusting for any intervening distance, communication of activation signals for blade cylinder 32 and associated blade 31, and therefore distribution of a length of web material 18 that adequately wraps around an article in a timely manner and without significant surplusage. Additionally, the electronic instructions may be configured for specific actions and data storage to produce multiple predetermined lengths of web material 18, as well as incorporating all the specific actions to take place at the push of a single button. For example, screen 41 may display a variety of pre-programmed article designations (icons, lists, product numbers, or the like) for selection by a user. In one or more alternate embodiments, control device 14 may be configured to accept inputs to engage the stored data and specific actions associated with a given article by non-manual (that is to say, other than manual entry) methods, such as by detection of one or more predetermined variables (i.e. height, weight, color, etc.) by an electronic sensor, scanning of a barcode from a label by a barcode scanner, or other predetermined input methods as may be now known in the art.

Figure 6:
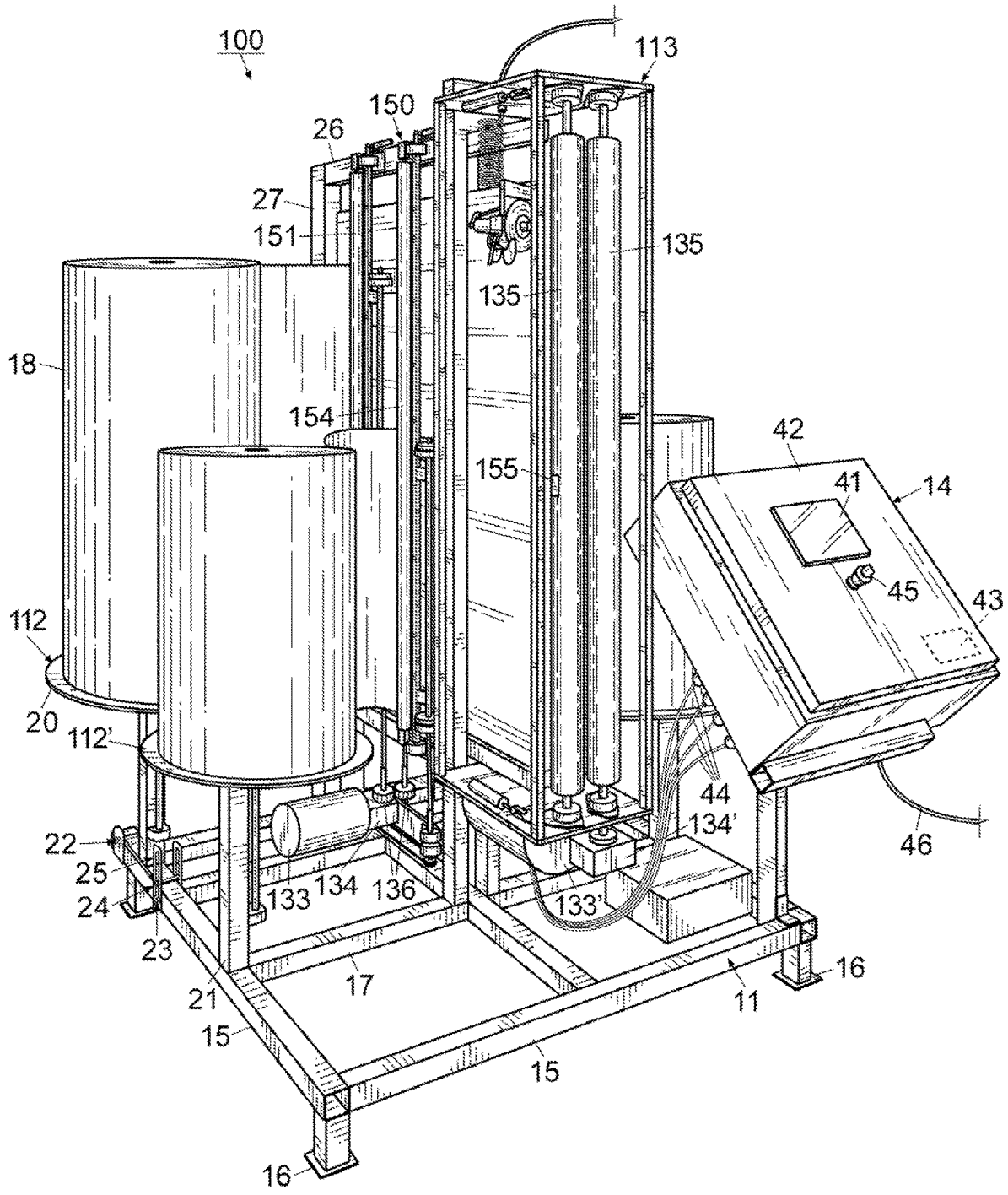
FIG. 6 shows an elevated side perspective view of an alternate embodiment of the packaging apparatus of FIG. 1.
Figure 7:
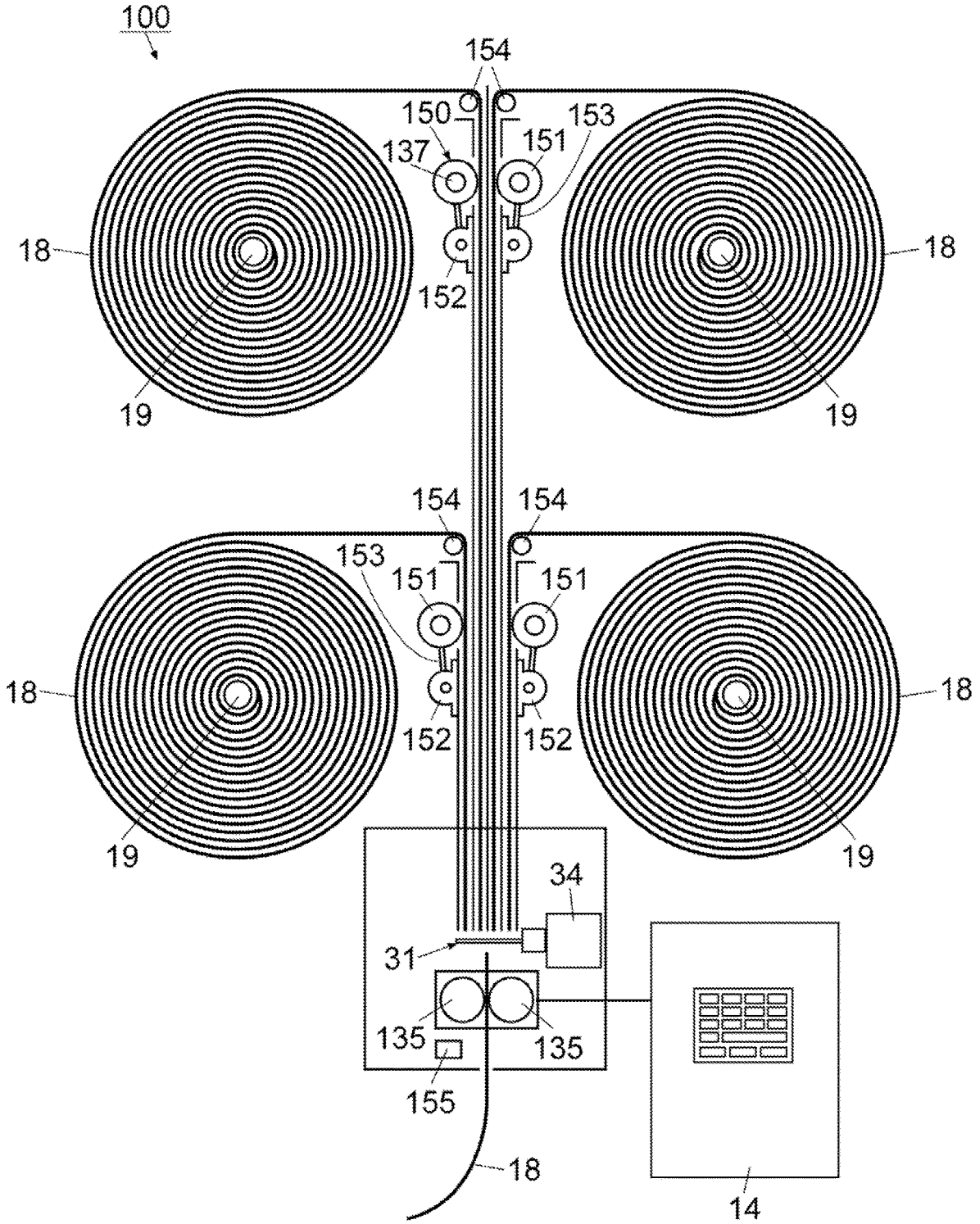
FIG. 7 pictures a top plan view of a schematic representation of the packaging apparatus of FIG. 6.

An alternate embodiment, packaging apparatus 100, is illustrated in FIGS. 6 and 7. Packaging apparatus 100 includes base 11, one or more spindles 112, 112' and cutting cabinet 113 (cover plates 30 and paper guides 38, 39 removed) in electronic communication with control device 14, similar to packaging apparatus 10. At least one, and preferably two of spindles 112 are of the pivotable nature previously described above, but packaging apparatus 100 may also include one or more spindles 112' which are fixed in the upright orientation. This combination of fixed and pivotable spindle structures may be advantageous for packaging apparatus 100, as it may better accommodate rolls of web material 18 defined by different widths, basis weight, or other web-related structural variables as would be understood in the art. As demonstrated in FIGS. 6-7 and described in further detail below, packaging apparatus 100 preferably includes a total of four spindles 112, 112', both fixed and pivotable species, to permit a wide range of operational flexibility. In this configuration, the fixed spindles 112' would be appropriate for smaller, narrower, or lighter webs 18 that could be mounted on spindles 112' by hand, while spindles 112 would be better suited to accommodate larger, wider, or heavier rolls of web material 18. By way of example, one configuration of web materials could include web species eighteen inches (45.72 cm), thirty inches (76.20 cm), thirty-four and a fourth inches (86.99 cm), and forty-two inches (106.68 cm) wide.

Figure 8:
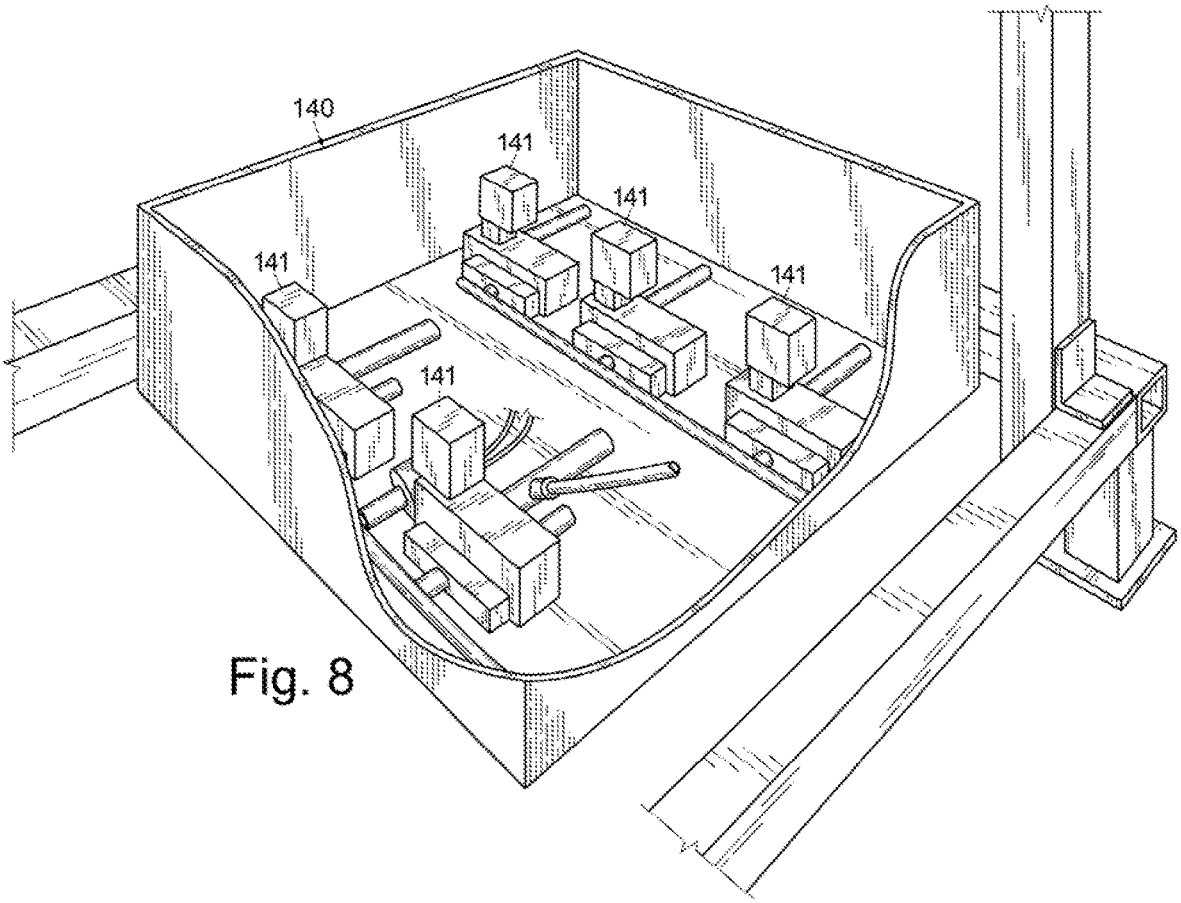
FIG. 8 depicts a valve assembly of the packaging apparatus of FIG. 6.

An embodiment of packaging apparatus 100 includes a power supply, preferably a motored power supply, and more preferably an electric-powered motor such as electric motor 133, providing rotational energy to transmission assembly 134 and ultimately driving powered rollers 151. Transmission assembly includes at least one gear 136, but preferably includes at least one gear 136 and associated axle 137 for each powered roller 151. In a similar manner, cabinet rollers 135 include a power supply, preferably electric motor 133' (similar in most respects to electric motor 133) that provides rotational energy to transmission assembly 134', which in turn may power one or both rollers 135. Transmission assembly 134' also preferably includes a counter (sometimes referred to as an encoder), such that the exact rotation of rollers 135 may be known and recorded. This information can be monitored by control device 14 to ensure precise use of web 18 during use. Additionally, or in the alternative, packaging apparatus 100 may further include valve assembly 140, preferably positioned proximate control device 14, for the management of various air flows used by packaging apparatus 100. As demonstrated more clearly in FIG. 8, valve assembly 140 (illustrated with house partially removed) includes one or more valve bodies 141, and preferably includes one valve body for each pre-feed assembly 150 as well as a valve body 141 for the functionality of cabinet 113.

As shown more clearly in the top plan schematic view of FIG. 7, packaging apparatus 100 includes one or more pre-feed assemblies 150, each which includes powered roller 151 pivotably attached to mount 152 by rod 153, including electric motor 133 and driven by transmission assembly 136 positioned about base 11. As web material 18 is spooled off of axle 19, it is routed towards pre-feed assembly 150 via guide 154. Web material 18 enters a longitudinally extending channel, whereby at least the outboard surface of web 18 is exposed. In an embodiment of packaging apparatus 100, roller 151 is in a constant state of counterclockwise rotation, and engaging the outboard surface of web material 18 is performed by rotating rod 153 on or off web 18 as desired. In an alternate embodiment of packaging apparatus 100, roller 151 does not commence counterclockwise rotation until an electronic signal is received from control device 14, at which time roller 151 begins rotation, or rod 153 is rotated until roller 151 contacts the outboard surface of web 18, and rotation of roller 151 begins thereafter. As roller 151 engages web 18, it is moved in the direction of cabinet 113. As demonstrated in FIG. 7, various species of web 18 may move in separate channels, divided by respective guides 154, or they move in an aggregated central channel, but either embodiment ends in cabinet 113. To better facilitate the travel of web 18, particularly to prevent wrinkling or rolling within the channels divided by guides 154, blocks of material (not shown) may be inserted to keep web 18 on a linear path.

Unlike cabinet 13 described previously, cabinet rollers 135 are positioned in the "front" of cabinet 113, that is to say more distal relative to spindles 112, 112' and more proximal to the article to be wrapped (not shown). This is possible due to the pre-feed assemblies 150 as described above. More specifically, the dispensing process begins as an article enters the packaging zone and a user inputs or selects the appropriate measurements or icon from the control device 14, and the corresponding pre-feed assembly 150 responds by engaging and driving the respective web 18 through the cutting area and received by main feed rollers 135, where web 18 is detected by sensor device 155 (for example an optical "eye" sensor). This detection by sensor device 155 generates one or more action responses from packaging apparatus 100, including the rotation of pre-feed roller 151 away from the web 18 and the termination of rotation by pre-fed assembly 150. The main feed roller 135 commence rotation, engaging web 18 and feeding and measuring web 18 by virtue of an encoder connected to transmission 134, which transmits the information to control box 14. When web material 18 reaches the predetermined length as programmed into control box 14 and selected by the user, rollers 135 stop rotating and air cylinder 34 is activated by instructions from control box 14 which directs blade 31 to progress (i.e. descend or ascend) through web 18, cutting the material to the requested length. Preferably, a signal is sent by control device 14 to pre-feed rollers 151 to retract web material 18 back away from blade 31, for example a small distance back into the feed channel such as two inches, to permit the next segment of web material 18 to pass through the cutting station of cabinet 113 without fouling the other lines of web material 18. Feed rollers 135 carry the separated length of web material 18 exterior of the cutting cabinet, for example through a slot similar to channel 40 as described above, where it can be retrieved manually and placed around an article to be packaged. In an alternate embodiment, a sensing device detects an input, for example an electronic scanner device detects an optical input such as a barcode or the like, and communicates the information via a wired or wireless network (not shown) to control device 14 for a similar cutting action via blade 31.

The illustrations and examples provided herein are for explanatory purposes and are not intended to limit the scope of the appended claims.

I claim:

1. A packaging apparatus comprising a base, a spindle, a separation station including a rotatable blade, and a control device, the spindle affixed to the base, the separation station and the control device mounted to the base, a pair of rollers oriented longitudinally relative to the separation station in the vertical direction and a motor in mechanical communication with one of the pair of rollers, and a plurality of electronic instructions operatively resident on the control device for:

storing one or more sets of variables related to an article, receiving an input identifying the article, in response to the input identifying the article, feeding a predetermined length of a web material based on the one or more sets of variables related to the article from the spindle to the separation station, and removing a section of web material from a larger supply of web material, whereby the section of web material is used in the packaging of the article.

2. The apparatus of claim 1, whereby the base is defined by a plurality of tubular base members forming a square shape.

3. The apparatus of claim 2, whereby the base further comprises one or more tubular cross-members arranged within the base.

4. The apparatus of claim 1, whereby the spindle includes a post and an axle affixed in opposing relation to a shield.

5. The apparatus of claim 4 further comprising a fixed clevis connected to the base, whereby the fixed clevis is configured to receive a portion of the post therein via a pin that does not laterally or longitudinally displace relative to the base.

6. The apparatus of claim 4 further comprising a displaceable clevis defining a slot and connected to the base, whereby the displaceable clevis is configured to receive a portion of the post therein via a pin that laterally and longitudinally displaces relative to the base within the slot.

7. The apparatus of claim 6, whereby the spindle is pivotably attached to the base, and configured to move from a first, more vertical position to a second, more angular position via the displaceable clevis and pin.

8. The apparatus of claim 1 further comprising a pair of gears, one gear connected to each roller and enmeshed with the other gear, whereby a rotational drive provided by the motor to one roller communicates to the other roller via the gears.

9. The apparatus of claim 1 whereby the rotatable blade is mounted to a blade cylinder, the blade cylinder longitudinally movable within the separation station relative to a longitudinal axis defined by the separation station.

10. The apparatus of claim 9, whereby the blade cylinder is pneumatically powered.

11. The apparatus of claim 1 comprising one or more large web material guides.

12. The apparatus of claim 11 further comprising one or more small web material guides.

13. The apparatus of claim 1, whereby the control device includes a touch screen.

14. The apparatus of claim 1 further comprising a second spindle attached to the base in laterally opposing relation to the first spindle, whereby the first and second spindles pivot in opposing directions.

15. The apparatus of claim 1, whereby the separation station further includes housing defined by a plurality of stanchions affixed to plates positioned at opposing ends.

16. The apparatus of claim 15 further comprising one or more cover plates.

17. A packaging apparatus comprising a base, a set of four spindles, a separation station including a rotatable blade, and a control device, the spindles each including a post and an axle affixed in opposing relation to a shield attached to the base, the separation station and the control device mounted to the base, a pair of rollers oriented longitudinally relative to the separation station in the vertical direction and a motor in mechanical communication with one of the pair of rollers, and a plurality of electronic instructions operatively resident on the control device for:

storing one or more sets of variables related to an article, receiving an input identifying the article, in response to the input identifying the article, feeding a predetermined length of a web material based on the one or more, sets of variables related to the article from the spindle to the separation station, and removing a section of web material from a larger supply of web material, whereby the section of web material is used in the packaging of the article.

18. The apparatus of claim 17 further comprising a pair of fixed clevises connected to the base, whereby the fixed clevises are each configured to receive a portion of different ones of the post therein via a fixed clevis pin that does not laterally or longitudinally displace relative to the base.

19. The apparatus of claim 18 further comprising a pair of displaceable clevises each defining a slot connected to the base, whereby the displaceable devises are each configured to receive a portion of different ones of the post therein via a displaceable clevis pin that laterally and longitudinally displaces relative to the base within the slot.

* * * * *